US007535447B2

(12) United States Patent
Kwak et al.

(10) Patent No.: US 7,535,447 B2
(45) Date of Patent: May 19, 2009

(54) PIXEL CIRCUIT AND ORGANIC LIGHT EMITTING DISPLAY

(75) Inventors: Won Kyu Kwak, Seongnam (KR); Sung Cheon Park, Suwon (KR)

(73) Assignee: Samsung Mobile Display Co., Ltd., Suwon (KR)

( * ) Notice: Subject to any disclaimer, the term of this patent is extended or adjusted under 35 U.S.C. 154(b) by 678 days.

(21) Appl. No.: 11/296,339

(22) Filed: Dec. 8, 2005

(65) Prior Publication Data

US 2006/0139257 A1 Jun. 29, 2006

(30) Foreign Application Priority Data

Dec. 9, 2004 (KR) ..... 10-2004-0103817

(51) Int. Cl.
*G09G 3/36* (2006.01)

(52) U.S. Cl. ..... 345/87

(58) Field of Classification Search ..... 345/76, 345/82, 83, 691, 693; 315/136, 169.3, 291
See application file for complete search history.

(56) References Cited

U.S. PATENT DOCUMENTS 5,952,789 A * 9/1999 Stewart et al. ..... 315/169.4
6,618,031 B1 * 9/2003 Bohn et al. ..... 345/83
2004/0183758 A1 9/2004 Chen et al.
2005/0068271 A1 * 3/2005 Lo ..... 345/76
2005/0093791 A1 5/2005 Lo

* cited by examiner

*Primary Examiner*—Richard Hjerpe
*Assistant Examiner*—Shaheda A Abdin
(74) *Attorney, Agent, or Firm*—H.C. Park & Associates, PLC

(57) ABSTRACT

An organic light emitting display includes a pixel circuit having first, second, and third organic light emitting diodes (OLEDs), for emitting red, green, and blue light, respectively, a driving circuit commonly connected to the OLEDs, and a switching circuits connected to the OLED and the driving circuit to sequentially control the driving thereof. By controlling a plurality of OLEDs, the number of pixel circuits in an organic light emitting display is reduced, thereby reducing the number of scan lines, data lines, and emission control lines, which in turn improves the aperture ratio of the light emitting display. Further, the emission order of the OLEDs is controlled so that it is possible to prevent the generation of color breakup.

25 Claims, 13 Drawing Sheets

PIXEL CIRCUIT AND ORGANIC LIGHT EMITTING DISPLAY

CROSS-REFERENCE TO RELATED APPLICATIONS

This application claims the benefit of and priority to Korean Patent Application No. 10-2004-103817, filed on Dec. 9, 2004, in the Korean Intellectual Property Office, the disclosure of which is incorporated herein by reference.

BACKGROUND

1. Field of the Invention

The present invention relates to a pixel circuit and an organic light emitting display, and in particular, a pixel circuit connected to a plurality of organic light emitting diodes (OLEDs) that emit light so that it is possible to improve the aperture ratio of the light emitting display using such a pixel circuit.

2. Discussion of Related Art

Recently, flat panel displays have been developed, that are of reduced weight and volume as compared with displays using cathode ray tubes (CRT). Highlighted are organic light emitting displays having improved luminous efficiency, brightness, and view angle and high response speed.

An OLED has a structure in which an emission layer that may be a light emitting thin film is positioned between a cathode electrode and an anode electrode. Electrons and corresponding holes are injected into the emission layer so that they are recombined to generate exciters whose energy is reduced. As a result, light is emitted.

In the OLED, the emission layer is formed of either organic or inorganic material. Types of OLEDs are divided into an inorganic OLEDs and an organic OLEDs according to the emission layer material.

Referring to FIG. 1, four adjacent pixels are shown each that include an OLED and a pixel circuit. The pixel circuit includes a first transistor M1, a second transistor M2, a third transistor M3, and a capacitor Cst. The first, second, and third transistors M1, M2, and M3 each includes a gate, a source, and a drain. The capacitor Cst includes a first electrode and a second electrode.

Since the pixels have the same structure, the pixel shown in the upper left of FIG. 1 will be described. The source of the first transistor M1 is connected to a power source supply line Vdd, the drain is connected to the source of the third transistor M3, and the gate is connected to a first node A. The first node A is connected to the drain of the second transistor M2. The first transistor M1 supplies current corresponding to a data signal to the OLEDs.

The source of the second transistor M2 is connected to a data line D1, the drain is connected to the first node A, and the gate is connected to a first scan line S1. The second transistor M2 transmits the data signal to the first node A in accordance with the scan signal applied to the second transistor's gate.

The source of the third transistor M3 is connected to the drain of the first transistor M1, the drain is connected to the anode electrode of the OLED, and the gate is connected to an emission control line E1 to respond to an emission control signal. Therefore, the third transistor M3 controls the flow of current that flows from the first transistor M1 to the OLED in accordance with the emission control signal to control emission of the OLED.

The first electrode of the capacitor Cst is connected to the power source supply line Vdd while the second electrode is connected to the first node A. The capacitor Cst charges in accordance with the data signal and applies the data signal to the gate of the first transistor M1 for one frame for operation of the first transistor M1 over the frame.

However, according to the pixel used for a typical organic light emitting display, since an OLED is connected to each pixel circuit, a plurality of pixel circuits are necessary in order to emit light from a plurality of OLEDs.

Also, since one emission control line is connected to each pixel row, the aperture ratio of the organic light emitting display deteriorates.

SUMMARY OF THE INVENTION

Accordingly, the present invention provides a pixel circuit, in which a plurality of OLEDs are connected to one pixel circuit. Thus it is possible to reduce the number of pixel circuits of an organic light emitting display and thereby improve its aperture ratio. Moreover, the emission times of the plurality of OLEDs are controlled so that it is possible to minimize color breakup in an organic light emitting display using such an arrangement.

According to a first aspect of the present invention, there is provided an organic light emitting display having a first pixel, a second pixel, and a third pixel. Each pixel includes: a first, second and third OLED for emitting red, green, and blue light, respectively; a driving circuit commonly connected to the OLEDs for driving; and a switching circuit connected to the OLEDs and the driving circuit to sequentially control the driving of the first, second, and third OLEDs. The first, second, and third pixels are arranged to receive a data signal through a common data line, and an emission order of red, green, and blue light components of each pixel are different from one another. Further, the driving circuit includes: a first transistor for receiving a first power source corresponding to a first voltage applied to its gate to selectively supply driving current to the OLEDs; a second transistor for selectively transmitting the data signal to a first electrode of the first transistor according to a first scan signal; a third transistor for selectively permitting a flow of electric current to the first transistor so that the first transistor serves as a diode according to the first scan signal; a capacitor for storing the voltage applied to the gate of the first transistor while a data voltage is applied to the first electrode of the first transistor and for maintaining the stored voltage in the gate of the first transistor in a period when the OLEDs emit light; a fourth transistor for selectively transmitting an initializing signal to the capacitor according to a second scan signal; a fifth transistor for selectively transmitting the first power source to the first transistor according to a first emission control signal; a sixth transistor for selectively transmitting the first power source to the first transistor according to a second emission control signal; and a seventh transistor for selectively transmitting the first power source to the first transistor according to a third emission control signal.

According to a second aspect of the present invention, there is provided an Is organic light emitting display having a first pixel, a second pixel, and a third pixel. Each pixel includes a first, second and third OLED for emitting red, green, and blue light, respectively; a driving circuit commonly connected to the OLEDs for driving; and a sequential control circuit connected to the OLEDs and the driving circuit to sequentially control the driving of the first, second, and third OLEDs. The first, second, and third pixels are arranged to receive a data signal through a common data line, and an emission order of red, green, and blue light components of each pixel are different from one another. Moreover, the driving circuit includes: a first transistor including a first electrode, a second electrode, and third electrode connected to a first node, a second node, and a third node, respectively; a second transistor including a first electrode, a second electrode, and third electrode connected to a data line, the second node, and a first scan line, respectively; a third transistor including a first electrode, a second electrode, and a third electrode are connected to the first node, the third node, and the first scan line, respectively; a fourth transistor including a first electrode, a second electrode, and a third electrode connected to the third node, an initializing signal line, and a second scan line, respectively; a capacitor including a first electrode and a second electrodes connected to a first power source and the third node, respectively; a fifth transistor including a first electrode, a second electrode, and a third electrode connected to the first node, the first power source, and a first emission control line, respectively; a sixth transistor including a first electrode, a second electrode, and a third electrode connected to the second node, the first power source and a second emission control line, respectively; and a seventh transistor including a first electrode, a second electrode, and a third electrode connected to the second node, the first power source, and a third emission control line, respectively.

According to a third aspect of the present invention, there is provided an organic light emitting display having a first pixel, a second pixel, and a third pixel. Each pixel includes a first, second and third OLED for emitting red, green, and blue light, respectively; a driving circuit commonly connected to the OLEDs for driving; and a sequential control circuit connected to the OLEDs and the driving circuit to sequentially control the driving of the first, second, and third OLEDs. The first, second, and third pixels are arranged to receive a data signal through a common data line, and an emission order of red, green, and blue light components of each pixel are different from one another. In addition, the driving circuit comprises: a first transistor including a first electrode, a second electrode, and third electrode connected to a first node, a second node, and a third node, respectively; a second transistor including a first electrode, second electrode, and third electrode connected to a data line, the first node, and a first scan line, respectively; a third transistor including a first electrode, second electrode, and third electrode connected to the second node, the third node, and the first scan line, respectively; a fourth transistor including a first electrode, second electrode, and third electrode connected to the third node, an initializing signal line, and a second scan line respectively; a capacitor including a first electrode and a second electrode connected to the first power source and the third node, respectively; a fifth transistor including a first electrode, second electrode, and third electrode connected to the second node, the first power source, and a first emission control line, respectively; a sixth transistor including a first electrode, second electrode, and third electrode connected to the second node, the first power source, and a third electrode connected a second emission control line, respectively; and a seventh transistor including a first electrode, second electrode, and third electrode connected to the second node, the first power source, and a third emission control line, respectively.

BRIEF DESCRIPTION OF THE DRAWINGS

The objects and advantages of the invention will become apparent and more readily appreciated from the following description of the preferred embodiments, taken in view of the accompanying drawings.

DETAILED DESCRIPTION OF THE INVENTION

Hereinafter, preferred embodiments of the present invention will be described with reference to the accompanying drawings.

Figure 1:
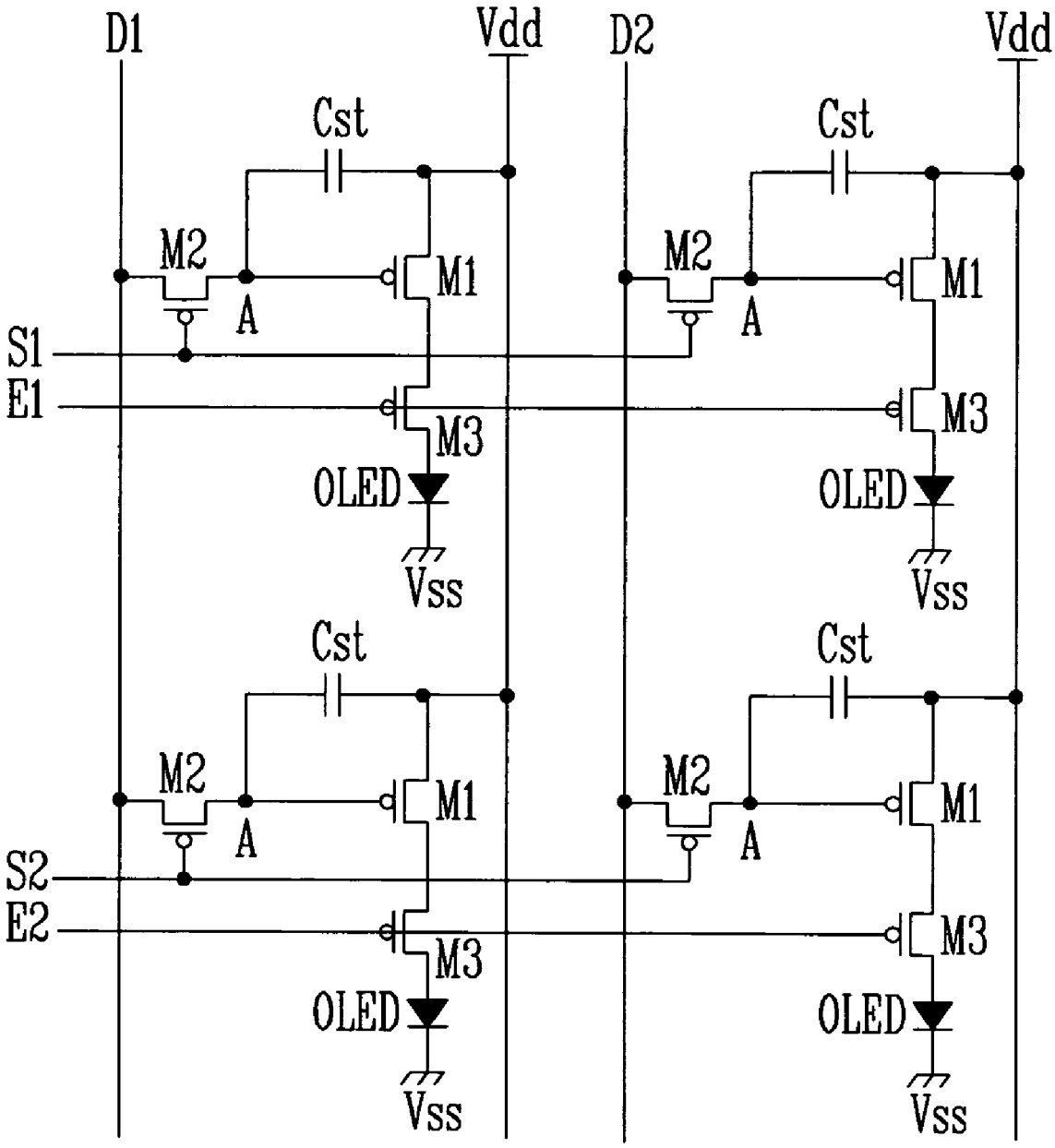
FIG. 1 (PRIOR ART)
FIG. 1 is a circuit diagram illustrating a section of a conventional organic light emitting display.
Figure 2:
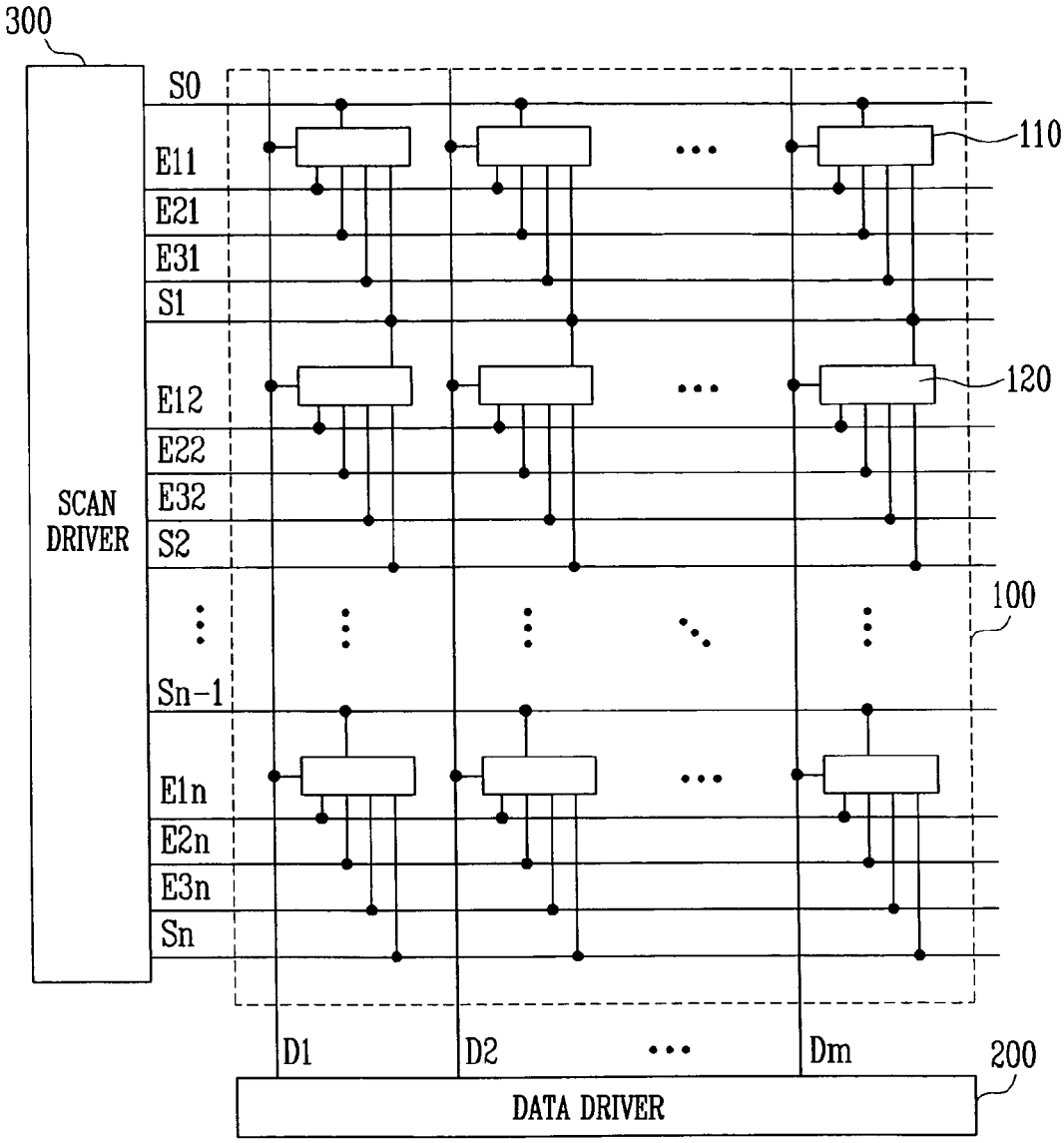
FIG. 2 illustrates the structure of an organic light emitting display according to an embodiment of the present invention.

Looking at FIG. 2, an organic light emitting display may include an image display unit 100, a data driver 200, and a scan driver 300.

The image display unit 100 can include a plurality of pixels 110 and 120 comprising a plurality of OLEDs, a plurality of scan lines S0, S1, S2 . . . Sn-1, and Sn arranged along a row direction, a plurality of first emission control lines E11, E12 . . . E1*n*-1, and E1*n*, second emission control lines E21, E22 . . . E2*n*-1, and E2*n*, and third emission control lines E31, E32 . . . E3*n*-1, and E3*n* also arranged along the row direction, a plurality of data lines D1, D2 . . . Dm-1, and Dm arranged along a column direction, and a plurality of pixel power source lines Vdd (not shown), which receive power sources from the outside to supply the pixel power sources.

The pixels 110 and 120 receive a scan signal from the adjacent scan lines S0 to Sn and generate driving currents corresponding to data signals provided by data lines D1 to Dm. The driving currents are transmitted to the OLEDs by emission control signals transmitted through the first emission control lines E11 to E1*n* to the third emission control lines E31 to E3*n* so that images are displayed.

In particular, adjacent first and second pixels 110 and 120 connected to one scan line S1 are connected to one pixel power source line Vdd to receive a pixel power source.

The data driver 200 is connected to the data lines D1 to Dm to transmit the data signals to the image display unit 100. One data line sequentially transmits red, green, and blue data.

The scan driver 300 is connected to the scan lines S0 to Sn and the first, second, and third emission control lines to sequentially transmit the scan signals and the emission control signals to the image display unit 100.

Figure 3:
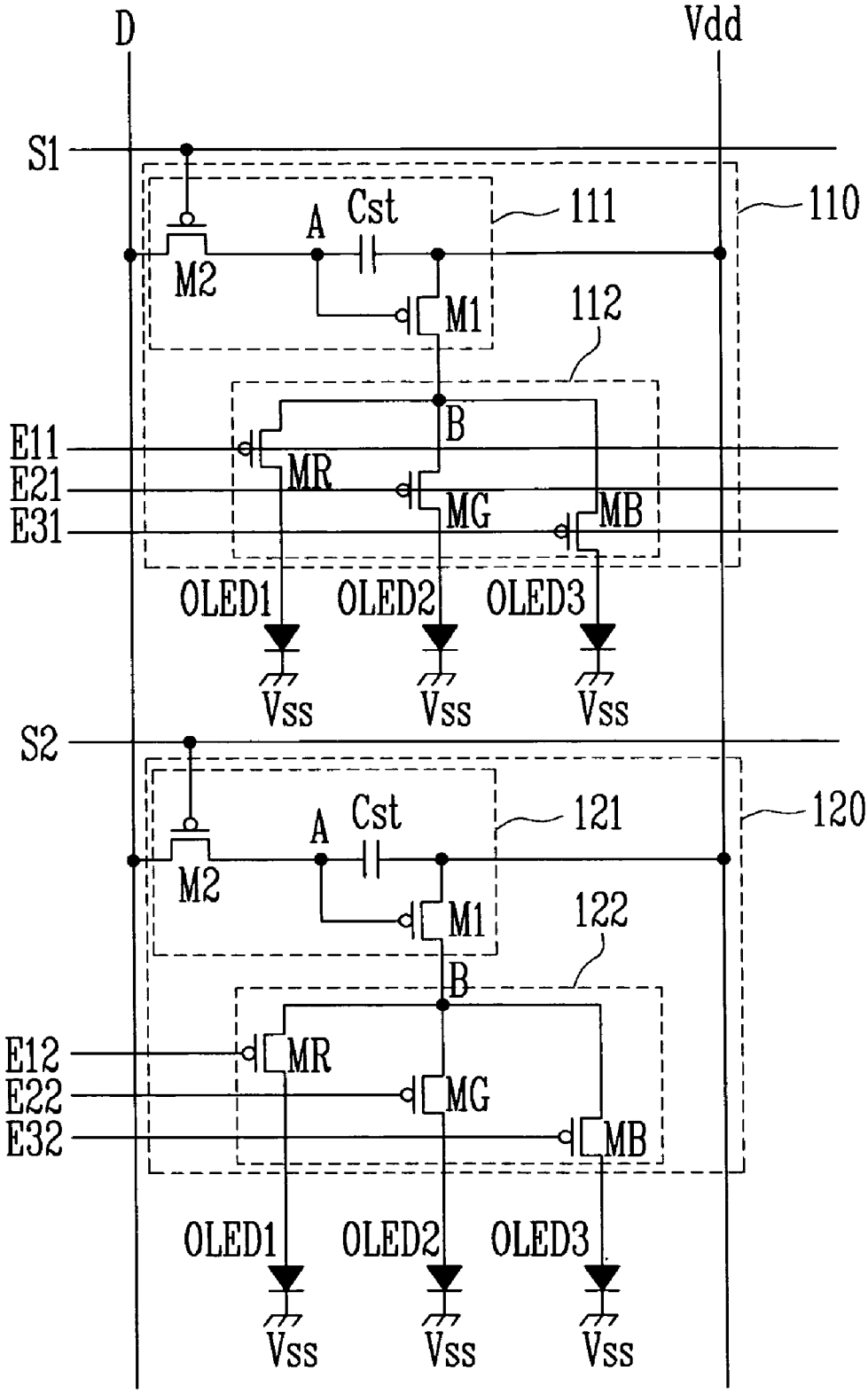
FIG. 3 is a circuit diagram illustrating a first embodiment of the image display unit used for the organic light emitting display of FIG. 2.

As shown in FIG. 3, the first and second pixels 110 and 120 are connected to one data line $D_m$. The first and second pixels 110 and 120 may each include driving circuits 111 and 121, switching circuits 112 and 122, and first to third OLEDs (OLED1 to OLED3).

The driving circuits 111 and 121 may include a first transistor M1, a second transistor M2, and a capacitor Cst. The switching circuits 112 and 122 may include a first switching device MR, a second switching device MG, a third switching device MB, and first to third OLEDs (OLED1 to OLED3). OLED1, OLED2, and OLED3 emit red, green, and blue light components, respectively.

In the first pixel 110, the source of the first transistor M1 is connected to the pixel power source line Vdd, the drain is connected to a second node B, and the gate is connected to a first node A so that the current that flows through the second node B is determined by the voltage of the first node A.

The source of the second transistor M2 is connected to the data line Dm, the drain is connected to the first node A, and the gate of the second transistor M2 is connected to the scan line Sn.

The first electrode of the capacitor is connected to the pixel power source line and the second electrode of the capacitor is connected to the first node A so that the capacitor stores the voltage corresponding to difference between the pixel power source and the voltage of the first node A.

The source of the first switching device MR is connected to the second node B, the drain is connected to the OLED1, and the gate is connected to the first emission control line E11 so that the first switching device MR selectively transmits the current that flows through the second node B to OLED1.

The source of the second switching device MG is connected to the second node B, the drain is connected to OLED2, and the gate is connected to the second emission control line E21 so that the second switching device MG selectively transmits the current that flows through the second node B to OLED2.

The source of the third switching device MB is connected to the second node B, the drain is connected to OLED3, and the gate is connected to the third emission control line E31 so that the third switching device MB selectively transmits the current that flows through the second node B to OLED3.

The second pixel 120, is arranged similar to the first pixel 110, but the switching devices MR, MG, and MB are respectively connected to emission control lines E12, E22, and E32.

Figure 4:
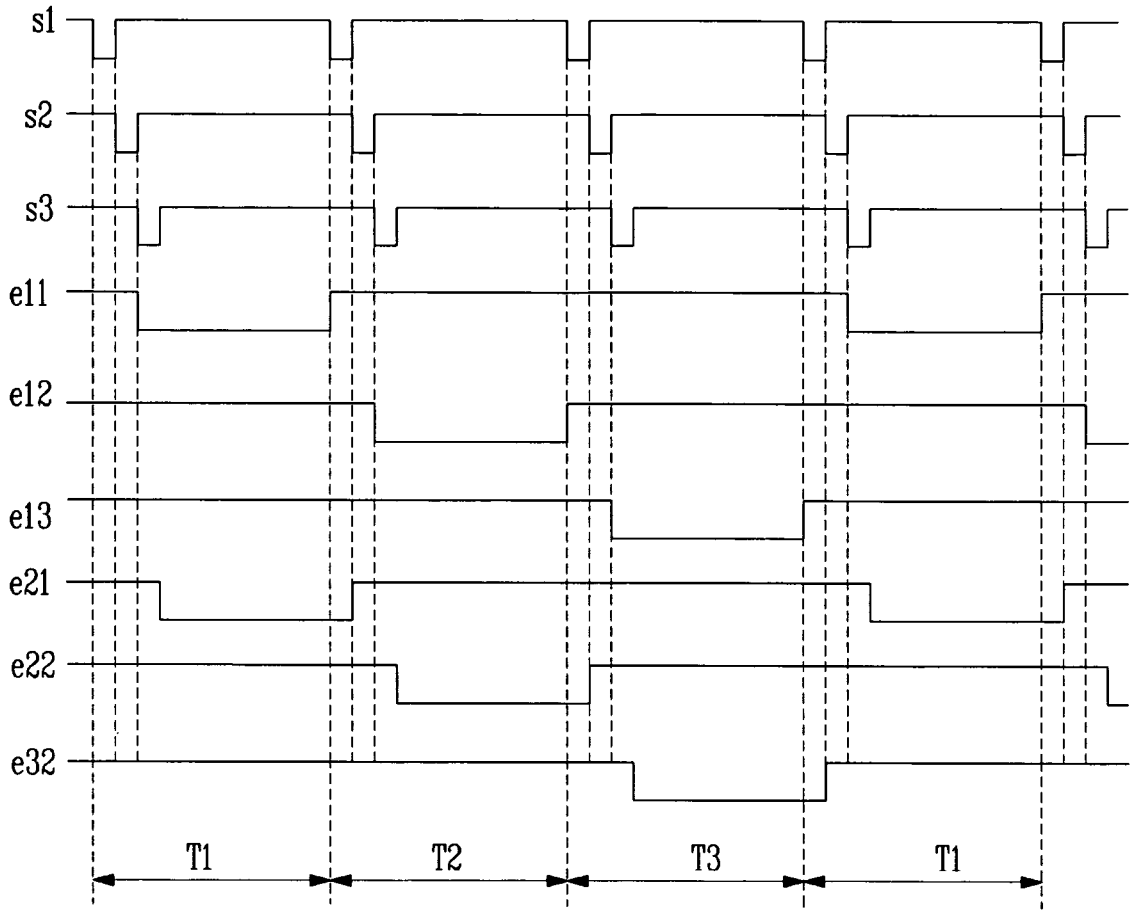
FIG. 4 illustrates waveforms of signals transmitted to the image display unit of FIG. 3.

Referring to FIG. 4, in operation, an image display unit receives first and second scan signals s1 and s2, data signals, first, second and third emission control signals e11, e21, and e31, which are followed by first, second, and third emission control signals e12, e22, and e32. The scan signals and the emission control signals repeat, first, second and third periods T1, T2 and T3.

First, in the first period T1, a red data signal is transmitted through a data line. At this time, when the red data signal is transmitted to the first node A through the first transistor M1 of the first pixel 110 by the first scan signal s1, the capacitor Cst stores the voltage corresponding to difference between the pixel power source and the data signal and the voltage corresponding to EQUATION 1 is transmitted between the gate electrode and the source electrode of the first transistor M1.

$$Vsg = Vdd - Vdata \quad \text{[EQUATION 1]}$$

Vsg, Vdd, and Vdata represent the voltage between the gate electrode and the source electrode of the first transistor M1, the voltage of the pixel power source, and the voltage of the data signal, respectively.

Therefore, the current corresponding to EQUATION 2 flows through the second node B.

$$I = \frac{\beta}{2}(Vgs - |Vth|)^2 = \frac{\beta}{2}((Vdd - Vdata) - |Vth|)^2 = \frac{\beta}{2}(Vdd - Vdata - |Vth|)^2 \quad \text{[EQUATION 2]}$$

Vgs, Vdd, Vdata, Vth, and β represent the voltage between the gate electrode and the source electrode of the first transistor M1, the voltage of the pixel power source, the voltage of the data signal, the threshold voltage of the first transistor, and the gain factor of the first transistor M1, respectively.

The current corresponding to the EQUATION 2 is transmitted to OLED1 of first pixel 110 by the first emission control signal e11 to emit red light.

A second pixel circuit is selected by the second scan signal s2 so that the red data signal is transmitted to the second pixel circuit and the current corresponding to the EQUATION 2 flows to the second node B. Current is transmitted to OLED1 of the second pixel circuit by the first emission control signal e12 so that red light is emitted.

In the second period T2, the first pixel circuit is selected by the first scan signal s1 so that a green data signal is transmitted. OLED2 of the first pixel circuit is selected by the second emission control signal e21 to emit green light.

The second pixel circuit is selected by the second scan signal s2 so that the green data signal is transmitted to the second pixel circuit and the current corresponding to the EQUATION 2 flows to the second node B. Current is transmitted to OLED2 by the second emission control signal e21 so that green light is emitted.

In the third period T3, the first pixel circuit is selected by the first scan signal s1 so that a blue data signal is transmitted. OLED3 of the first pixel circuit is selected by the third emission control signal e31 to emit blue light.

The second pixel circuit is selected by the second scan signal s2 so that the blue data signal is transmitted to the second pixel circuit. The current corresponding to the EQUATION 2 flows to the second node B. Current is transmitted to OLED3 by the third emission control signal e32 so that blue light is emitted.

Therefore, three OLEDs are controlled by a single pixel circuit, thereby reducing the number of pixel circuits required for the image display unit 100. As a result, it is possible to improve the aperture ratio of the image display unit 100. However, since the red light is emitted in the first period T1, the green light is emitted in the second period T2, and the blue light is emitted in the third period T3, only one color is emitted per period so that color breakup is generated. Also, since the current value varies with deviation in the threshold voltage of the first transistor M1, image quality can deteriorate.

Figure 5A:
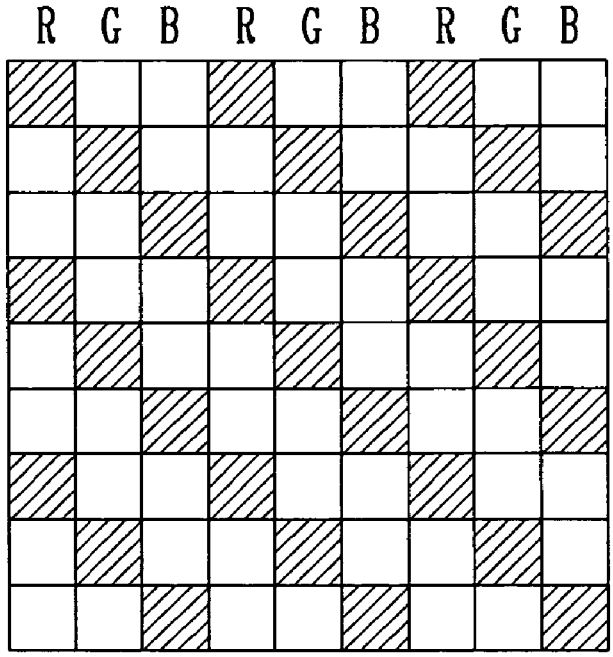
FIG. 5A, FIG. 5B, and FIG. 5C illustrate how the organic light emitting display of FIG. 3 emits light in accordance with the signals of FIG. 4 in one frame.
Figure 5B:
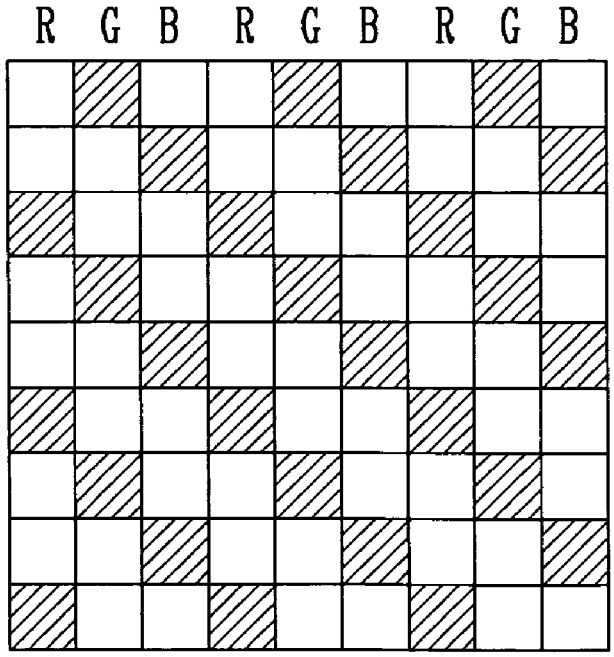
Figure 5C:
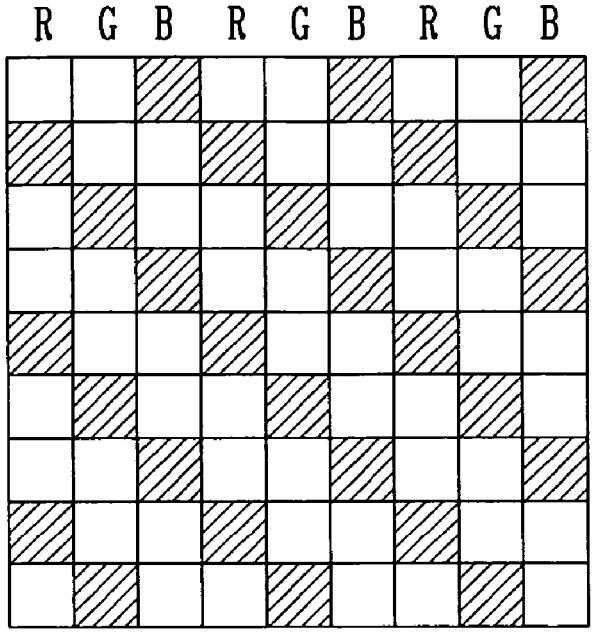

FIG. 5A, FIG. 5B, and 5C illustrate first to third sub-fields included in one frame, respectively. As illustrated in FIG. 5A, red, green, and blue light components are emitted in the first sub-field. As illustrated in FIG. 5B, red, green, and blue light components are emitted in the second sub-field. As illustrated in FIG. 5C, red, green, and blue light components are emitted in the third sub-field. One row of each sub-field emits light components of the same color. Because all of the colors are displayed in each sub-field, however, color breakup is not significant.

Figure 6A:
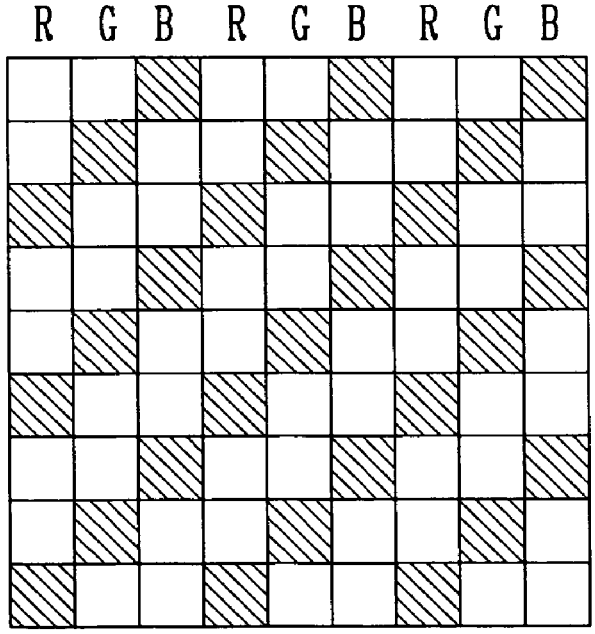
FIG. 6A, FIG. 6B, and FIG. 6C illustrate how the organic light emitting display of FIG. 3 emits light in one frame.
Figure 6B:
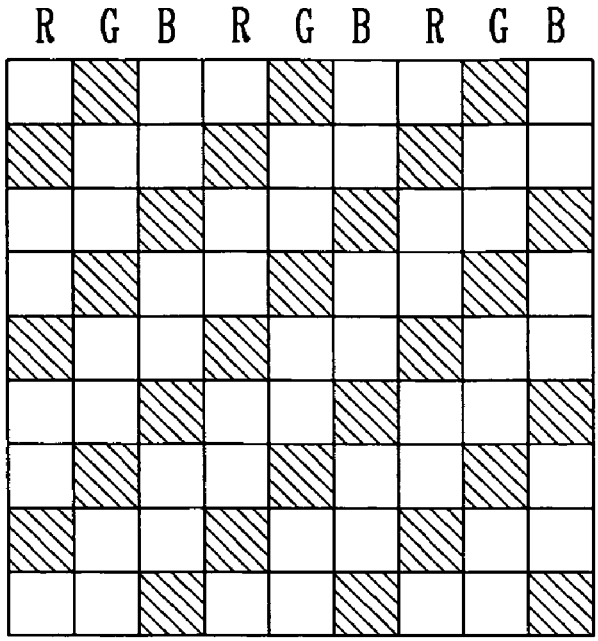
Figure 6C:
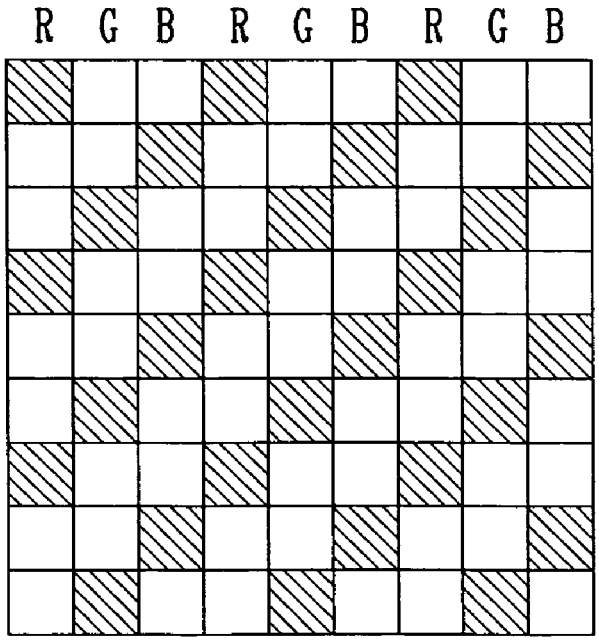

Also, the emission control signals can be controlled so that light is emitted as illustrated in FIG. 6A, FIG. 6B, and FIG. 6C.

Figure 7:
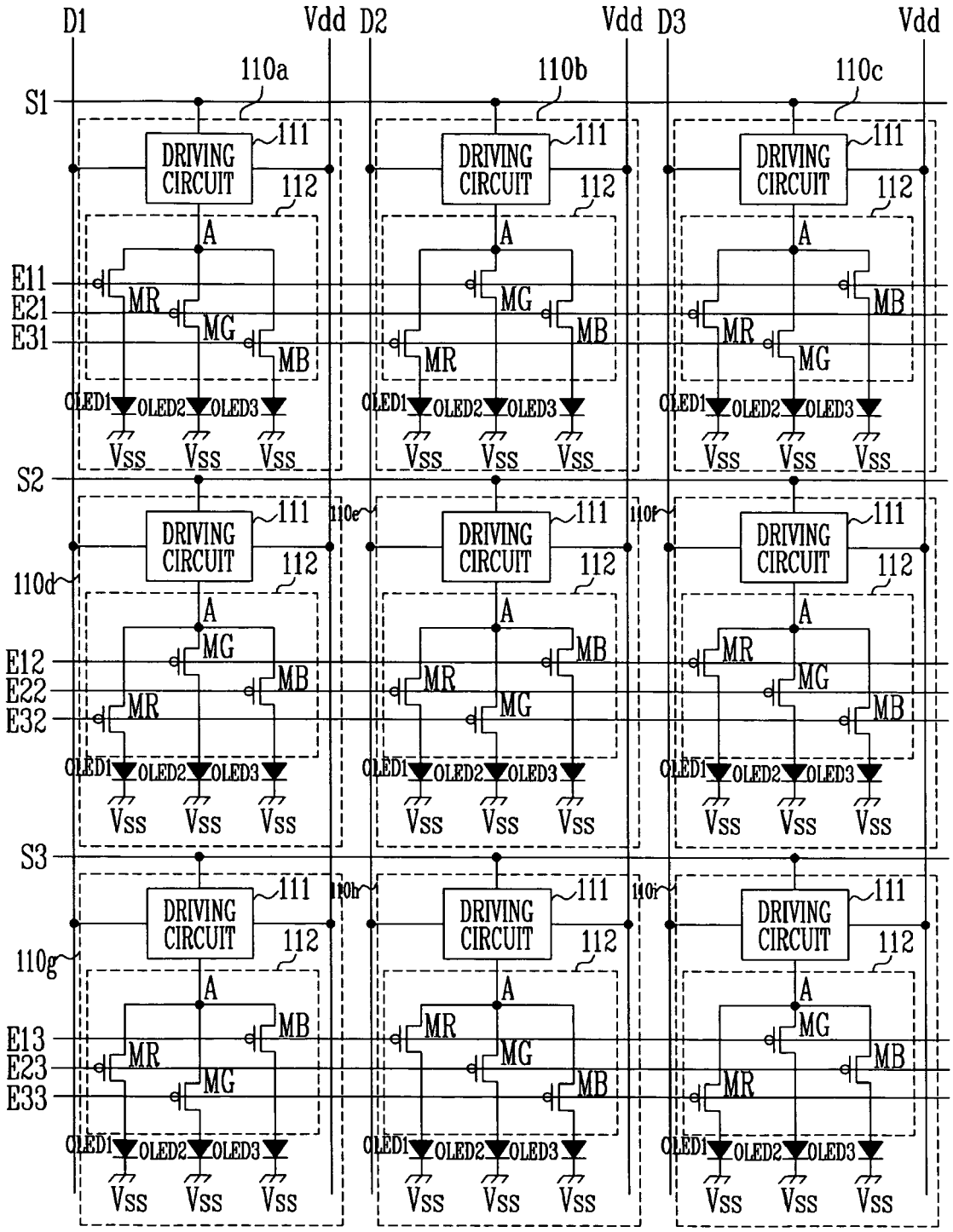
FIG. 7 is a circuit diagram illustrating a section of another embodiment of the image display unit used for the organic light emitting display of FIG. 2.

Turning to FIG. 7, three pixels are connected to one data line and three pixels are connected to one scan line so that a total of nine pixels are displayed. The pixels are referred to as first to ninth pixels 110*a* through 110*i*, respectively. Each pixel may include a driving circuit 111, a switching circuit 112, and first to third OLEDs (OLED1 to OLED3). In each pixel, the driving circuit 111 receives the pixel power source Vdd, the data signals, and the scan signal s1 to generate current so that the current flows to the first node A.

The switching circuit 112 included in each pixel includes switching devices MR, MG, and MB. The source of the first switching device MR is connected to the first node A and the drain is connected to OLED1. The source of the second switching device MG is connected to the first node A and the drain is connected to OLED2. The source of the third switching device MB is connected to the first node A and the drain is connected to OLED3.

The first switching device MR of the first pixel 100*a*, the second switching device MG of the second pixel 100*b*, and the third switching device MB of the third pixel 100*c* are sequentially connected to the first emission control line E11. The second switching device MG of the first pixel 100*a*, the third switching device MB of the second pixel 100*b*, and the first switching device MR of the third pixel 100*c* are sequentially connected to the second emission control line E21. The third switching device MB of the first pixel 100*a*, the first switching device MR of the second pixel 100*b*, and the second switching device MG of the third pixel 100*c* are sequentially connected to the third emission control line E31.

The second switching device MG of the fourth pixel 100*d*, the third switching device MB of the fifth pixel 100*e*, and the first switching device MR of the sixth pixel 100*f* are sequentially connected to the first emission control line E12. The third switching device MB of the fourth pixel 100*d*, the first switching device MR of the fifth pixel 100*e*, and the second switching device MG of the sixth pixel 100*f* are sequentially connected to the second emission control line E22. The first switching device MR of the fourth pixel 100*d*, the second switching device MG of the fifth pixel 100*e*, and the third switching device MB of the sixth pixel 100*f* are sequentially connected to the third emission control line E32 that comes second.

The third switching device MB of the seventh pixel 100*g*, the first switching device MR of the eighth pixel 100*h*, and the second switching device MG of the ninth pixel 100*i* are sequentially connected to the first emission control line E13. The first switching device MR of the seventh pixel 100*g*, the second switching device MG of the eighth pixel 100*h*, and the third switching device MB of the ninth pixel 100*i* are sequentially connected to the second emission control line E22. The second switching device MB of the seventh pixel 100*g*, the third switching device MB of the eighth pixel 100*h*, and the first switching device MR of the ninth pixel 100*i* are sequentially connected to the third emission control line E33.

Figure 8:
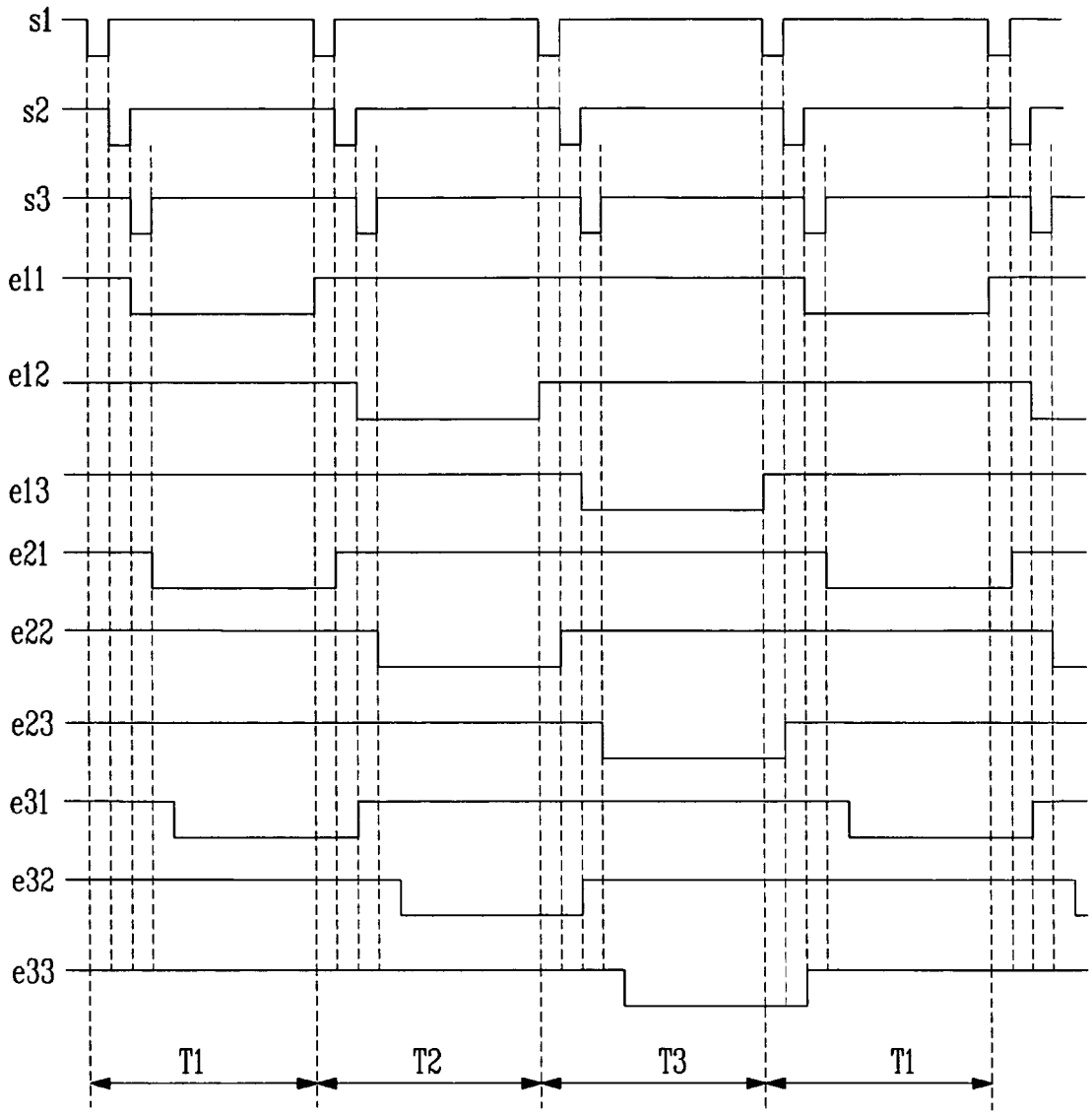
FIG. 8 illustrates waveforms of signals transmitted to the organic light emitting display of FIG. 7.

As shown in FIG. 8, the image display unit 100 first receives a first group of the first, second, and third emission control signals e11, e21, and e31, a second group of the first, second, and third emission control signals e12, e22, and e32 come next, and then a third group of the first, second, and third emission control signals e13, e23, and e33 to transmit currents to the OLEDs. The emission control signals repeat over the first, second, and third periods T1, T2, and T3.

In the first period T1, when the first scan signal s1 is transmitted to the driving circuit 111, the red, green, and blue data signals are transmitted through the first, second, and third data lines D1, D2, and D3, respectively, so that the first, second, and third pixels 100*a*, 100*b*, and 100*c* emit the red, green, and blue light components, respectively.

When the second scan signal s2 is transmitted to the driving circuit 111, the green, blue, and red data signals are transmitted through the first, second, and third data lines D1, D2, and D3, respectively, so that the fourth, fifth, and sixth pixels 100*d*, 100*e*, and 100*f* emit the green, blue, and red light components, respectively.

When the third scan signal s3 is transmitted to the driving circuit 111, the blue, red, and green data signals are transmitted through the first, second, and third data lines D1, D2, and D3, respectively, so that the seventh, eighth, and ninth pixels 100*g*, 100*h*, and 100*i* emit the blue, red, and green light components, respectively.

In the second period T2, when the first scan signal s1 is transmitted to the driving circuit 111, the green, blue, and red data signals are transmitted through the first, second, and third data lines D1, D2, and D3, respectively, so that the first, second, and third pixels 100*a*, 100*b*, and 100*c* emit the green, blue, and red light components, respectively.

When the second scan signal s2 is transmitted to the driving circuit 111, the blue, red, and green data signals are transmitted through the first, second, and third data lines D1, D2, and D3, respectively, so that the fourth, fifth, and sixth pixels 100*d*, 100*e*, and 100*f* emit the blue, red, and green light components, respectively.

When the third scan signal s3 is transmitted to the driving circuit 111, the red, green, and blue data signals are transmitted through the first, second, and third data lines D1, D2, and D3, respectively, so that the seventh, eighth, and ninth pixels 100*g*, 100*h*, and 100*i* emit the red, green, and blue light components, respectively.

In the third period T3, when the first scan signal s1 is transmitted to the driving circuit 111, the blue, red, and green data signals are transmitted through the first, second, and third data lines D1, D2, and D3, respectively, so that the first, second, and third pixels 100*a*, 100*b*, and 100*c* emit the blue, red, and green light components, respectively.

When the second scan signal s2 is transmitted to the driving circuit 111, the red, green, and blue data signals are transmitted through the first, second, and third data lines D1, D2, and D3, respectively, so that the fourth, fifth, and sixth pixels 100*d*, 100*e*, and 100*f* emit the red, green, and blue light components, respectively.

When the third scan signal s3 is transmitted to the driving circuit 111, the green, blue, and red data signals are transmitted through the first, second, and third data lines D1, D2, and D3, respectively, so that the seventh, eighth, and ninth pixels 100*g*, 100*h*, and 100*i* emit the green, blue, and red light components, respectively.

Figure 9A:
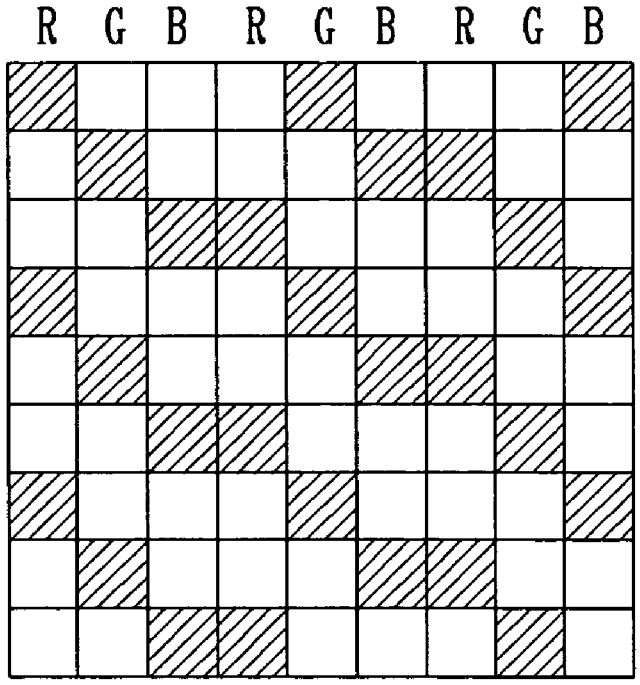
FIGS. 9A, FIG. 9B, and FIG. 9C illustrate that an organic light emitting display emits light in accordance with the signals of FIG. 8 in one frame.
Figure 9B:
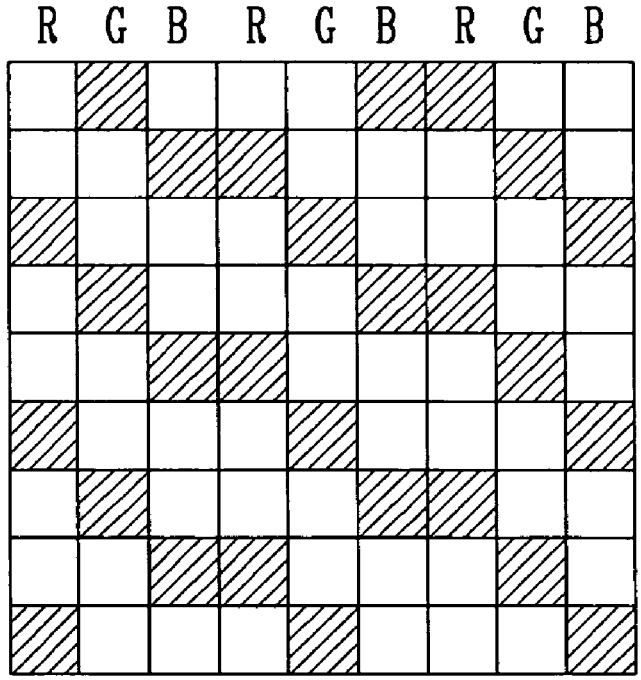
Figure 9C:
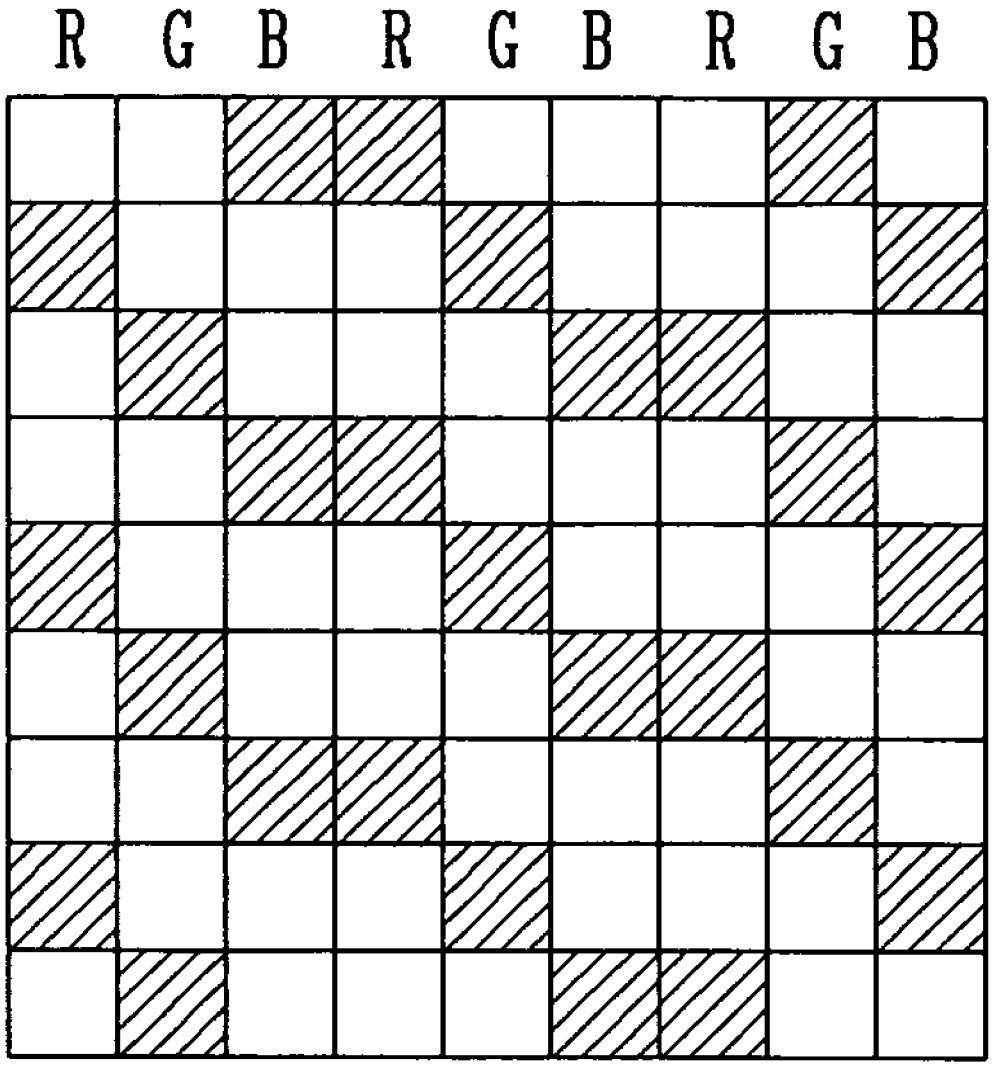

FIG. 9A, FIG. 9B, and FIG. 9C illustrate first to third sub-fields included in one frame, respectively. As illustrated in FIG. 9A, red, green, and blue light components are emitted in the first sub-field. As illustrated in FIG. 9B, red, green, and blue light components are emitted in the second sub-field. As illustrated in FIG. 9C, red, green, and blue light components are emitted in the third sub-field.

One row of each sub-field emits the red, green, and blue light components, which is different from the sub-fields shown in FIGS. 5A to 5C or FIGS. 6A to 6C, so that color breakup is not generated.

Figure 10:
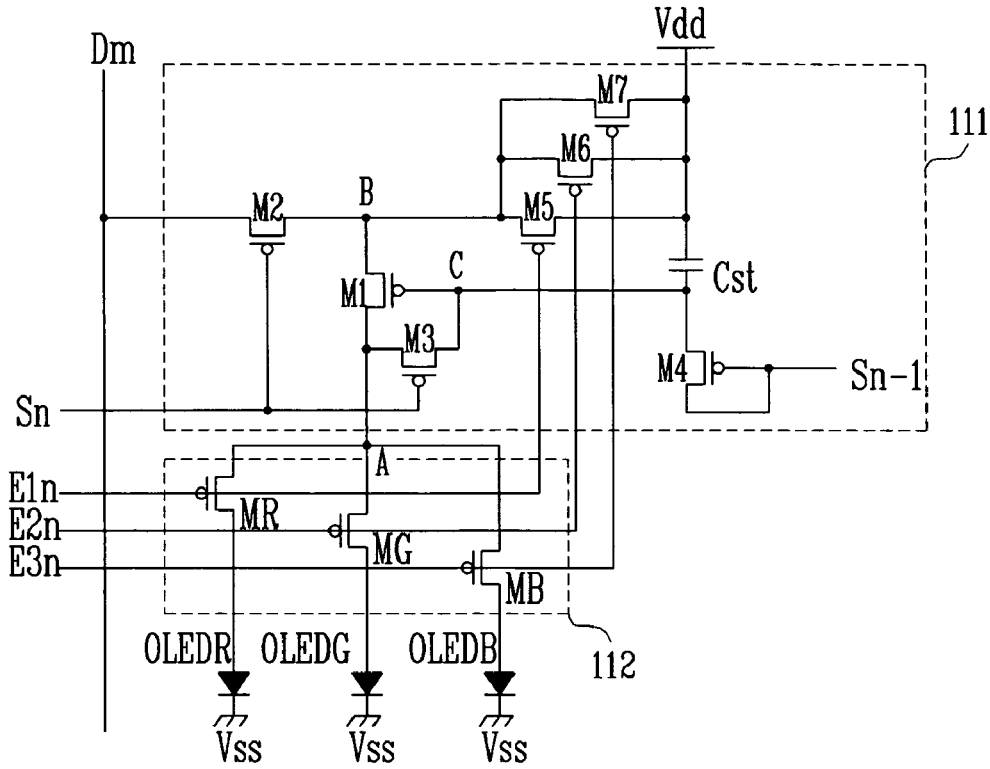
FIG. 10 is a circuit diagram illustrating a pixel for which the driving circuit of FIG. 8 according to an embodiment is used.

Referring to FIG. 10, the pixel circuit, may include first to seventh transistors M1 to M7, first to third switching devices MR, MG, and MB, and a capacitor Cst. Each transistor and switching device may include a source, a drain, and a gate. The capacitor Cst may include a first electrode and a second electrode. Since the drains and sources of the first to seventh transistors M1 to M7 and the first to third switching devices MR, MG, and MB have no physical differences, each source and drain may be referred to as a first electrode and a second electrode.

The drain of the first transistor M1 is connected to a first node A, the source is connected to a second node B, and the gate is connected to a third node C so that current flows from the second node B to the first node A in accordance with the voltage of the third node C.

The source of the second transistor M2 is connected to the data line Dm, the drain is connected to the second node B, and the gate is connected to the first scan line Sn so that the second transistor M2 performs a switching operation in accordance with the scan signal transmitted through the first scan line Sn to selectively transmit the data signal transmitted through the data line Dm to the second node B.

The source of the third transistor M3 is connected to the first node A, the drain is connected to the third node C, and the gate is connected to the first scan line Sn so that the potential of the first node A is made equal to the potential of the third node C by the scan signal transmitted through the first scan line Sn. Therefore, electric current flows through the first transistor M1 so that the first transistor M1 serves as a diode.

The source and gate of the fourth transistor M4 are connected to the second scan line Sn-1 and the drain is connected to the third node C so that the fourth transistor M4 transmits an initializing signal to the third node C. The initial signal is the scan signal sn-1 input to the row that precedes the row from which the first scan line Sn inputs a scan signal by one row.

The source of the fifth transistor M5 is connected to the pixel power source line Vdd, the drain is connected to the second node B, and the gate is connected to the first emission control line E1*n* so that the fifth transistor M5 selectively transmits the pixel power source to the second node B according to the emission control signal transmitted through the first emission control line E1*n*.

The source of the sixth transistor M6 is connected to the pixel power source line Vdd, the drain is connected to the second node B, and the gate is connected to the second emission control line E2*n* so that the sixth transistor M6 selectively transmits the pixel power source to the second node B according to the emission control signal transmitted through the second emission control line E2*n*.

The source of the seventh transistor M7 is connected to the pixel power source line Vdd, the drain is connected to the second node B, and the gate is connected to the third emission control line E3*n* so that the seventh transistor M7 selectively transmits the pixel power source to the second node B according to the emission control signal transmitted through the third emission control signal E3*n*.

The source of the first switching device MR is connected to the first node A, the drain is connected to OLED1, and the gate is connected to the first emission control line E1*n* so that the first switching device MR transmits the current that flows through the first node A to OLED1 according to the emission control signal transmitted through the first emission control line E1*n* to emit light from OLED1.

The source of the second switching device MG is connected to the first node A, the drain is connected to OLED2, and the gate is connected to the second emission control line E2*n* so that the second switching device MG transmits the current that flows through the first node A to OLED2 according to the emission control signal transmitted through the second emission control line E2*n* to emit light from OLED2.

The source of the third switching device MB is connected to the first node A, the drain is connected to OLED3, and the gate is connected to the third emission control line E3*n* so that the third switching device MB transmits the current that flows through the first node A to OLED3 according to the emission control signal transmitted through the third emission control line E3*n* to emit light from OLED3.

The first electrode of the capacitor Cst is connected to the pixel power source line Vdd and the second electrode is connected to the third node C so that the capacitor Cst is initialized by the initializing signal transmitted to the third node C through the fourth transistor M4 and the voltage corresponding to the data signal is stored and transmitted to the third node C. Therefore, the gate voltage of the first transistor M1 is maintained for a predetermined time by the capacitor Cst.

Figure 11:
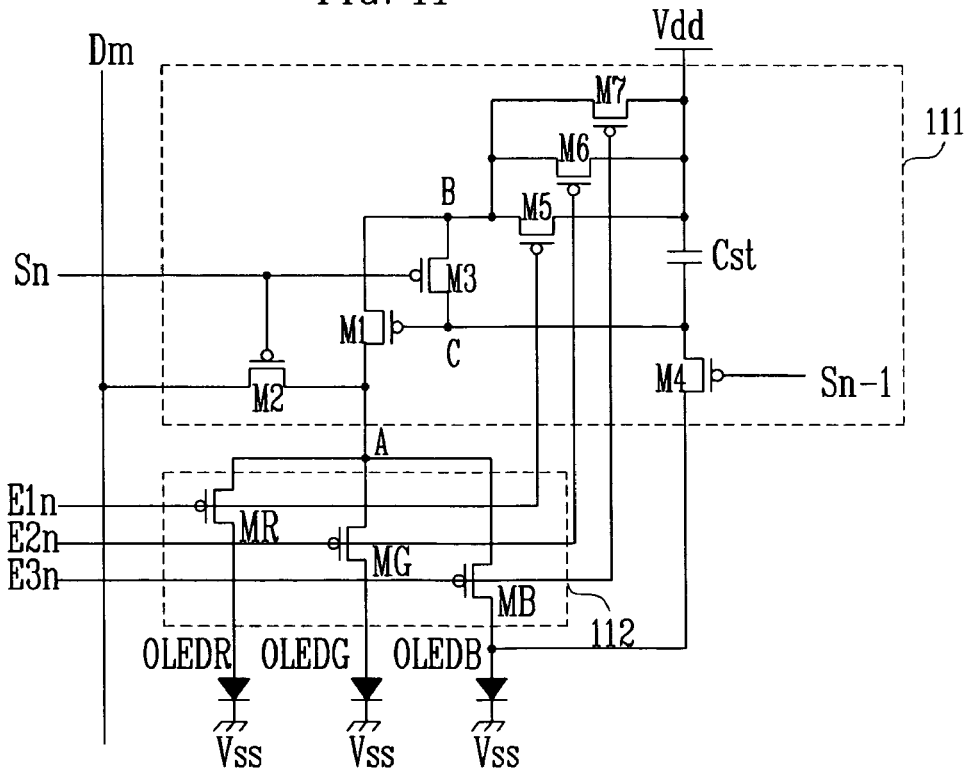
FIG. 11 is a circuit diagram illustrating a pixel for which the driving circuit of FIG. 8 according to another embodiment is used.

Referring to FIG. 11, another pixel circuit is shown that also may include first to seventh transistors M1 to M7 and a capacitor Cst. Only the differences between the pixel illustrated in FIG. 10 and the pixel illustrated in FIG. 11 will now be described.

Here, the source of the second transistor M2 is connected to the data line Dm, the drain is connected to the first node A, and the gate is connected to the first scan line Sn so that the second transistor M2 performs a switching operation in accordance with the scan signal transmitted through the first scan line Sn to selectively transmit the data signal transmitted through the data line Dm to the first node A.

The source of the third transistor M3 is connected to the second node B, the drain is connected to the third node C, and the gate is connected to the first scan line Sn so that the potential of the second node B is made equal to the potential of the third node C by the scan signal transmitted through the first scan line Sn. Therefore, electric current flows through the first transistor M1 so that it serves as a diode.

The source of the fourth transistor M4 is connected to the anode electrode of OLEDs, the drain is connected to the third node C, and the gate is connected to the second scan line Sn-1 so that the fourth transistor M4 transmits a voltage, when no current flows to the first to third OLEDs (OLED1 to OLED3), to the third node C in accordance with the scan signal from the second scan line Sn-1. At this time, the voltage transmitted to the third node C in accordance with the scan signal from scan line Sn-1 is used as an initializing signal for initializing the capacitor Cst.

Figure 12:
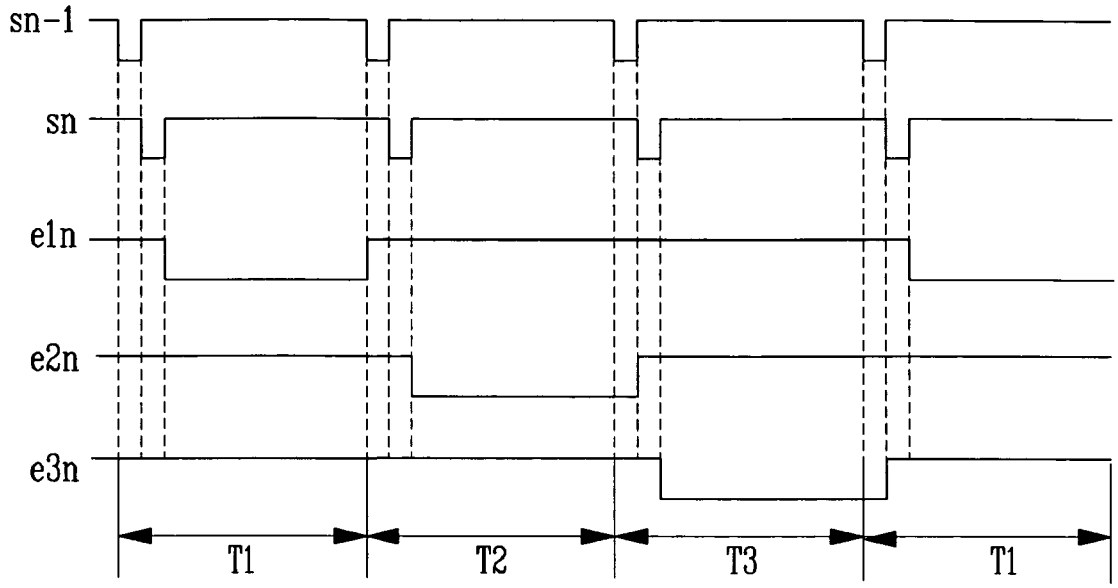
FIG. 12 illustrates waveforms that illustrate the operations of the pixels of FIG. 10 and FIG. 11.

Referring to FIG. 12, the pixel is operated using first and second scan signals sn and sn-1, the data signals, and the first, second, and third emission control signals e1*n*, e2*n*, and e3*n*. The first and second scan signals sn and sn-1 and the first to third emission control signals e1*n* to e3*n* are periodical signals and the second scan signal sn-1 is transmitted to a scan line that precedes the scan line to which the first scan signal sn is transmitted.

In the first time period T1, first, when the fourth transistor M4 is turned on by the second scan signal sn-1, in the case of FIG. 8, the second scan signal sn-1 is transmitted to the capacitor Cst through the fourth transistor M4 so that the capacitor Cst is initialized. In the pixel of FIG. 11, the voltage applied to the OLEDs when they do not emit light is transmitted to the capacitor Cst through the fourth transistor M4 so that the capacitor Cst is initialized.

Second, the second and third transistors M2 and M3 are turned on by the first scan signal sn so that the potential of the second node B is made equal to the potential of the third node C. Therefore, electric current flows through the first transistor M1 so that it serves as a diode. As a result, the data signal is transmitted to the second electrode of the capacitor Cst through the second transistor M2, the first transistor M1, and the third transistor M3 so that the voltage corresponding to difference between the data signal and the threshold voltage is transmitted to the second electrode of the capacitor Cst.

After the first scan signal sn is transmitted at a high level, when the first emission control signal e1*n* is transmitted at a low level for a predetermined period, the fifth and sixth transistors M5 and M6 are turned on by the first emission control signal e1*n* so that the voltage corresponding to EQUATION 3 is applied between the gate and source of the first transistor M1.

$$Vsg = Vdd - (V\text{data} - Vth) \quad \text{[EQUATION 3]}$$

Vsg, Vdd, Vdata, and Vth represent the voltage between the source and gate electrodes of the first transistor M1, the voltage of the pixel power source, the voltage of the data signal, and the threshold voltage of the first transistor M1, respectively.

The sixth transistor M6 is turned on so that current corresponding to EQUATION 4 flows to the OLEDs.

$$I = \frac{\beta}{2}(Vgs - Vth)^2 = \frac{\beta}{2}(Vdata - Vdd + Vth - Vth)^2 = \frac{\beta}{2}(Vdata - Vdd)^2 \quad \text{[EQUATION 4]}$$

I, Vgs, Vdd, Vth, and Vdata represent the current that flows through the first node A, the voltage applied to the gate of the first transistor M1, the voltage of the pixel power source, the threshold voltage of the first transistor M1, and the voltage of the data signal, respectively.

Therefore, the current that flows to the first node A flows regardless of the threshold voltage of the first transistor M1.

Similar to the current in the first time period T1, the currents in the second time period T2 and the third time period T3 flow from the first node A to the second and third OLEDs (OLED2 and OLED3, respectively) by the second and third emission control signals e2*n* and e3*n*, respectively.

Figure 13:
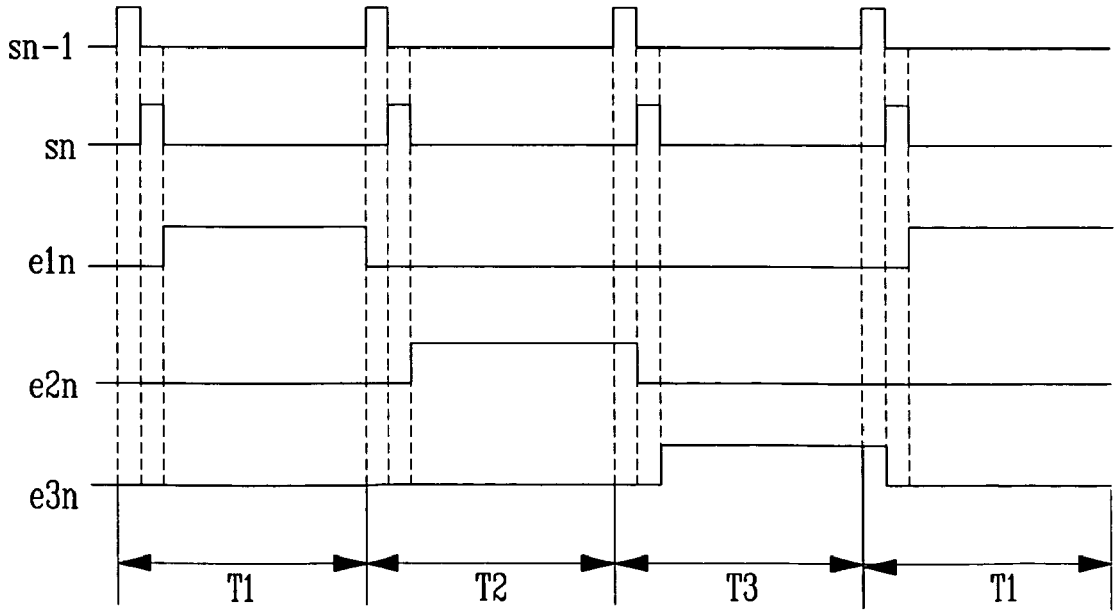
FIG. 13 illustrates waveforms that illustrate the operations of the pixels of FIG. 10 and FIG. 11 when the pixels are formed of NMOS transistors.

Here, the pixels illustrated in FIGS. 11 and 12 are formed of PMOS transistors. When the pixels are to be formed of NMOS transistors, the waveforms illustrated in FIG. 13 are input.

Although preferred embodiments of the present invention have been shown and described, it would be appreciated by those skilled in the art that changes might be made to the embodiments described herein without departing from the principles and spirit of the invention, the scope of which is defined in the appended claims and their equivalents.

What is claimed is:

1. An organic light emitting display comprising a first pixel, a second pixel, and a third pixel, each pixel comprising:

a first organic light emitting diode (OLED), a second OLED, and a third OLED for emitting red, green, and blue light, respectively;

a driving circuit commonly connected to the first, second, and third OLEDs for driving thereof; and a switching circuit connected to the OLEDs and the driving circuit to sequentially control the driving of the first, second, and third OLEDs, wherein the first pixel, the second pixel, and the third pixel are arranged to receive a data signal through a common data line, and an emission order of red, green, and blue light components of the first, second, and third pixels are different from each other, and wherein the driving circuit comprises:

a first transistor for receiving a first power source corresponding to a first voltage applied to a gate thereof to selectively supply driving current to the OLEDs;

a second transistor for selectively transmitting the data signal to a first electrode of the first transistor according to a first scan signal;

a third transistor for selectively permitting a flow of electric current to the first transistor so that the first transistor serves as a diode according to the first scan signal;

a capacitor for storing the voltage applied to the gate of the first transistor while a data voltage is applied to the first electrode of the first transistor and for maintaining the stored voltage in the gate of the first transistor in a period when the OLEDs emit light;

a fourth transistor for selectively transmitting an initializing signal to the capacitor according to a second scan signal;

a fifth transistor for selectively transmitting the first power source to the first transistor according to a first emission control signal;

a sixth transistor for selectively transmitting the first power source to the first transistor according to a second emission control signal; and a seventh transistor for selectively transmitting the first power source to the first transistor according to a third emission control signal.

2. The organic light emitting display of claim 1, wherein the switching circuit comprises:

a first switching device including a first electrode connected to the driving circuit and a second electrode connected to the first OLED;

a second switching device including a first electrode connected to the driving circuit and a second electrode connected to the second OLED; and a third switching device including a first electrode connected to the driving circuit and a second electrode connected to the third OLED, wherein gates of each of the first, second, and third switching devices receive different emission control signals among the first, second, and third emission control signals, respectively, to operate.

3. The organic light emitting display of claim 1, wherein the second scan signal is transmitted to a second scan line that precedes a first scan line to which the first scan signal is transmitted.

4. The organic light emitting display of claim 1, wherein an initializing voltage is transmitted by the second scan signal.

5. The organic light emitting display of claim 4, wherein the initializing voltage is a voltage applied to the OLEDs when no current flows through the first transistor.

6. The organic light emitting display of claim 1, further comprising a scan driver transmitting the scan signals and the emission control signals.

7. The organic light emitting display of claim 1, further comprising a data driver transmitting the data signal.

8. The organic light emitting display of claim 7, wherein the data driver transmits data signals having information on red, green, and blue light components during a first period, a second period, and a third period through a data line, wherein the data signals are transmitted in the order of red, green, and blue in the first period, wherein the data signals are transmitted in the order of green, blue, and red in the second period, and wherein the data signals are transmitted in the order of blue, red, and green in the third period.

9. The organic light emitting display as claimed in claim 7, wherein the data driver transmits red, green, and blue data to the data lines when one of the scan signals is transmitted to the driving circuits of the respective first, second, and third pixels.

10. An organic light emitting display comprising a first pixel, a second pixel, and a third pixel, each pixel comprising:

a first organic light emitting diode (OLED), a second OLED, and a third OLED;

a driving circuit commonly connected to the first, second, and third OLEDs for driving thereof; and a sequential control circuit connected to the OLEDs and the driving circuit to sequentially control the driving of the first, second, and third OLEDs, wherein the first pixel, the second pixel, and third pixel are arranged to receive a data signal through a common data line, and an emission order of red, green, and blue light components of the first, second, and third pixels are different from each other, and wherein the driving circuit comprises:

a first transistor including a first electrode, a second electrode, and a third electrode connected to a first node, a second node, and a third node, respectively;

a second transistor including a first electrode, a second electrode, and a third electrode connected to a data line, the second node, and a first scan line, respectively;

a third transistor including a first electrode, a second electrode, and a third electrode are connected to the first node, the third node, and the first scan line, respectively;

a fourth transistor including a first electrode, a second electrode, and a third electrode connected to the third node, an initializing signal line, and a second scan line, respectively;

a capacitor including a first electrode and a second electrode connected to a first power source and the third node, respectively;

a fifth transistor including a first electrode, a second electrode, and a third electrode connected to the first node, the first power source, and a first emission control line, respectively;

a sixth transistor including a first electrode, a second electrode, and a third electrode connected to the second node, the first power source and a second emission control line, respectively; and a seventh transistor including a first electrode, a second electrode, and a third electrode connected to the second node, the first power source, and a third emission control line, respectively.

11. The organic light emitting display of claim 10, wherein the sequential control circuit comprises:

a first switching device including a first electrode connected to the driving circuit and a second electrode connected to the first OLED;

a second switching device including a first electrode connected to the driving circuit and a second electrode connected to the second OLED; and a third switching device including a first electrode connected to the driving circuit and a second electrode connected to the third OLED, wherein gates of each of the first, second, and third switching devices are connected to different emission control lines among the first, second, and third emission control lines.

12. The organic light emitting display of claim 10, wherein a second scan signal is transmitted to the second scan line that precedes the first scan line to which a first scan signal is transmitted.

13. The organic light emitting display of 10, wherein the initializing signal line is connected to an anode electrode of at least one OLED.

14. The organic light emitting display of claim 10, further comprising a scan driver transmitting scan signals through the scan lines and emission control signals through the emission control lines.

15. The organic light emitting display of claim 10, further comprising a data driver transmitting data signals through the data line.

16. The organic light emitting display of claim 15, wherein the data driver transmits data signals having information on red, green, and blue light components during a first period, a second period, and a third period through the data line, wherein the data signals are transmitted in the order of red, green, and blue in the first period, wherein the data signals are transmitted in the order of green, blue, and red in the second period, and wherein the data signals are transmitted in the order of blue, red, and green in the third period.

17. The organic light emitting display as claimed in claim 15, wherein the data driver transmits red, green, and blue data to the data lines when a scan signal from one of the scan lines is transmitted to the driving circuits of the respective first, second, and third pixels.

18. An organic light emitting display comprising a first pixel, a second pixel, and a third pixel, each pixel comprising:

a first organic light emitting diode (OLED), a second OLED, and a third OLED;

a driving circuit commonly connected to the first, second, and third OLEDs for driving thereof; and a sequential control circuit connected to the OLEDs and the driving circuit to sequentially control the driving of the first, second, and third OLEDs, wherein the first pixel, the second pixel, and the third pixel are arranged to receive a data signal through a common data line, and the emission order of red, green, and blue light components of the first, second, and third pixels are different from each other, and wherein the driving circuit comprises:

a first transistor including a first electrode, a second electrode, and a third electrode connected to a first node, a second node, and a third node, respectively;

a second transistor including a first electrode, a second electrode, and a third electrode connected to a data line, the first node, and a first scan line, respectively;

a third transistor including a first electrode, a second electrode, and a third electrode connected to the second node, the third node, and the first scan line, respectively;

a fourth transistor including a first electrode, a second electrode, and a third electrode connected to the third node, an initializing signal line, and a second scan line respectively;

a capacitor including a first electrode and a second electrode connected to the first power source and the third node, respectively;

a fifth transistor including a first electrode, a second electrode, and a third electrode connected to the second node, the first power source, and a first emission control line, respectively;

a sixth transistor including a first electrode, a second electrode, and a third electrode connected to the second node, the first power source, and a second emission control line, respectively; and a seventh transistor including a first electrode, a second electrode, and a third electrode connected to the second node, the first power source, and a third emission control line, respectively.

19. The organic light emitting display of claim 18, wherein the sequential control circuit comprises:

a first switching device including a first electrode connected to the driving circuit and a second electrode connected to the first OLED;

a second switching device including a first electrode connected to the driving circuit and a second electrode connected to the second OLED; and a third switching device including a first electrode connected to the driving circuit and a second electrode connected to the third OLED, wherein gates of each of the first, second, and third switching devices are connected to different emission control lines among the first, second, and third emission control lines.

20. The organic light emitting display of 18, wherein a second scan signal is transmitted to the second scan line that precedes the first scan line to which a first scan signal is transmitted.

21. The organic light emitting display of claim 18, wherein the initializing signal line is connected to an anode electrode of at least one of the OLEDs.

22. The organic light emitting display of claim 18, further comprising a scan driver transmitting scan signals through the scan lines and emission control signals through the emission control lines.

23. The organic light emitting display as claimed in any one of claims 18, further comprising a data driver transmitting the data signal through the data line.

24. The organic light emitting display of claim 23, wherein the data driver transmits data signals having information on red, green, and blue light components during a first period, a second period, and a third period through the data line, wherein the data signals are transmitted in the order of red, green, and blue in the first period, wherein the data signals are transmitted in the order of green, blue, and red in the second period, and wherein the data signals are transmitted in the order of blue, red, and green in the third period.

25. The organic light emitting display of claim 24, wherein the data driver transmits red, green, and blue data to the data lines when a scan signal from one of the scan lines is transmitted to the driving circuits of the respective first, second, and third pixels.

* * * * *